US010823538B2

(12) United States Patent
Mandelbaum

(10) Patent No.: US 10,823,538 B2
(45) Date of Patent: Nov. 3, 2020

(54) EXPLOSIVE SYSTEM

(71) Applicant: RAFAEL ADVANCED DEFENSE SYSTEMS LTD, Haifa (IL)

(72) Inventor: Shlomo Mandelbaum, Haifa (IL)

(73) Assignee: RAFAEL ADVANCED DEFENSE SYSTEMS LTD., Haifa (IL)

( * ) Notice: Subject to any disclaimer, the term of this patent is extended or adjusted under 35 U.S.C. 154(b) by 4 days.

(21) Appl. No.: 16/327,834

(22) PCT Filed: Aug. 30, 2017

(86) PCT No.: PCT/IL2017/050968
§ 371 (c)(1),
(2) Date: Feb. 24, 2019

(87) PCT Pub. No.: WO2018/047160
PCT Pub. Date: Mar. 15, 2018

(65) Prior Publication Data

US 2019/0195603 A1 Jun. 27, 2019

(30) Foreign Application Priority Data

Sep. 8, 2016 (IL) ..... 247736

(51) Int. Cl.
*F42B 12/20* (2006.01)

(52) U.S. Cl.
CPC ..... *F42B 12/207* (2013.01); *F42B 12/208* (2013.01)

(58) Field of Classification Search
CPC ..... Y10S 102/705; F42B 3/087; F42B 3/093; F42B 3/02; F42B 39/00; F42B 39/26; F42B 12/208; F42B 12/207; F42D 5/00; F42D 1/02; F42C 15/18; F42C 15/184; F42C 15/188; F42C 15/192; F42C 15/196
USPC ..... 102/478, 481, 288, 293, 315, 317, 320, 102/705
See application file for complete search history.

(56) References Cited

U.S. PATENT DOCUMENTS

| | | | | |
|---|---|---|---|---|
| 4,646,641 A * | 3/1987 | Casey | F42B 1/02 | 102/306 |
| 7,895,947 B1 * | 3/2011 | Sutherland | F42C 15/188 | 102/254 |
| 8,256,350 B2 * | 9/2012 | Haskins | F42B 12/207 | 102/478 |
| 8,661,982 B2 * | 3/2014 | Rohr | F42B 12/02 | 102/215 |

(Continued)

FOREIGN PATENT DOCUMENTS

| | | |
|---|---|---|
| EP | 1269104 A1 | 1/2003 |
| WO | 03040645 A1 | 5/2003 |

*Primary Examiner* — Jonathan C Weber
(74) *Attorney, Agent, or Firm* — Mark M. Friedman

(57) ABSTRACT

An explosive system and corresponding method employ a number of explosive portions, each of sub-critical dimensions so that initiation of the portion would result in incomplete detonation. A selectively-deployable spacer arrangement or deployment mechanism is deployed between a storage state in which gaps or misalignments are maintained between the explosive portions so that the explosive system remains undetonatable, and a detonable state in which the portions are brought together sufficiently to function as a combined explosive charge having effective dimensions larger than critical dimensions, rendering the explosive system detonatable.

17 Claims, 8 Drawing Sheets

(56) References Cited

U.S. PATENT DOCUMENTS

| | | | | |
|---|---|---|---|---|
| 8,943,971 | B1 * | 2/2015 | Sherlock | F42B 12/207<br>102/478 |
| 9,638,504 | B1 * | 5/2017 | Sutherland | F42C 15/34 |
| 10,260,849 | B2 * | 4/2019 | Piehler | F42B 12/208 |
| 2010/0236443 | A1 * | 9/2010 | Haskins | F42B 12/207<br>102/478 |
| 2016/0097620 | A1 * | 4/2016 | Graswald | F42B 1/02<br>102/332 |
| 2018/0274891 | A1 * | 9/2018 | Piehler | F42B 12/208 |

* cited by examiner

FIG. 8A
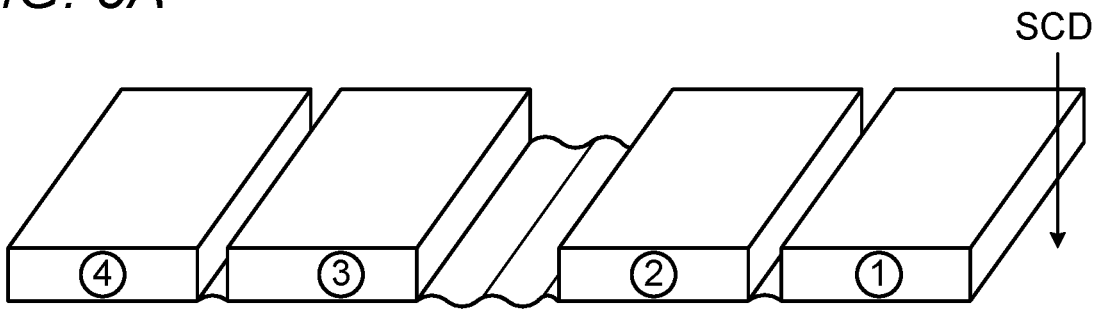
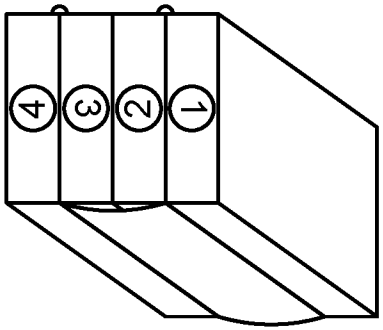
FIG. 8B

EXPLOSIVE SYSTEM

FIELD AND BACKGROUND OF THE INVENTION

The present invention relates to explosive devices and, in particular, it concerns a system and method for rendering an explosive device non-detonable until it is transformed into a detonable state.

The sensitivity of an explosive charge to various stimuli is a major concern in many situations such as storage, transportation, handling and tactical usage. In particular explosive charges are vulnerable to external stimuli such as detonation of nearby charges (sympathetic detonation), fire that can "go DDT" (deflagration to detonation transition), bullet impact, fragment impact and the effect of shaped-charge jets. There is a need to reduce the sensitivity of explosive systems to all of the above-mentioned stimuli in order to reduce the risks to personnel and property in the vicinity of explosive devices.

There is also a need to provide warheads of scalable effects, meaning that one can vary the performance output by choosing which part of the explosive will detonate and which part will undergo only low-level reaction such as deflagration or burning. Making such choice is of importance in avoiding unnecessarily powerful explosive blasts when not specifically needed.

The level of sensitivity to various stimuli depends on the specific charge configuration, including but not limited to parameters such as type of explosive, charge dimensions and structure.

In order to detonate in its entirety, an explosive body must have certain minimal dimensions, generally referred to as critical dimensions, such as critical diameter or critical thickness, depending on the specific shape of the body. If any of the body dimensions is below the critical dimension, the detonation will not propagate throughout the body even if initiated at a certain point. The general underlying reason for non-propagation in such case is the pressure release at the body surface and the resultant inability to sustain the detonation process. The type of critical dimension may depend on the specific shape of the explosive charge. For example for an axi-symmetric body one can define a critical diameter and a critical length (or axial thickness); for a body of a rectangular box (or plate) shape there are critical length, width and height (or thickness) dimensions. The critical values typically depend on the type of explosive and the configuration of material surrounding the explosive, referred to as "confinement". For example, in case of a cylindrical explosive charge, the higher the mass of a surrounding casing, the lower the effective critical diameter is for a particular device. It should be noted that in the literature the term "failure diameter" is used essentially equivalently with the term critical diameter.

As a matter of definition, we will refer to an explosive body (or charge) as "sub-critical" if at least one of its dimensions is below the pertinent critical dimension, or in other words sub-critical. As only one of the dimensions of the body needs to be sub-critical to render the entire body sub-critical and there is no limitation on the other dimensions, a sub-critical explosive body is in general not limited in its mass. In the description hereinafter it is assumed that the description refers to sub-critical elements of only one sub-critical dimension (that is to say the other dimensions are above the critical value). A sub-critical explosive body is non-detonable, i.e., it will not detonate in its entirety even if a reaction has started at some point within the body.

This property can also be used to render a collection of multiple small charges undetonable, even if the sum-total of the quantity of explosives is relatively large. One example of such a collection of charges is disclosed in US Patent Application Publication No. 2006/0037509, which provides a scent-training tool for training dogs to identify explosives. By maintaining sufficient separation between a plurality of sub-critical charges separated from each other by an inert carrier medium, a reaction will not propagate from one charge that has been initiated (and in which the reaction extinguishes due to pressure release) to the other charges. The basic property of the device as taught in US Patent Application Publication No. 2006/0037509 is referred to herein as being "non-detonable". Detonation of such a device is neither required nor possible.

It has been proposed to enhance the safety of an explosive device by designing it to lie close to the limits that will support detonation. One such example is U.S. Pat. No. 8,256,350 which discloses a warhead formed from at least two portions of high explosive separated by a non-detonative material, wherein each portion has a cross section below its critical detonation cross section. The configuration is such that each portion alone if initiated will not support detonation, but simultaneous detonation of all of the portions causes detonation to occur. In an explosive charge system consisting of multiple sub-critical charges, the propagation of the detonation depends on the separation distance, geometry and the separating material (air or other materials). In the example of U.S. Pat. No. 8,256,350, closely spaced cylindrical charges are arranged with a small space left between each charge, and the surrounding space is filled with an inert non-detonating binder. In such a configuration, when an explosive pellet was detonated near one of the cylindrical charges, the cylinder did not sustain detonation (because of its small diameter) and the detonation did not propagate to the other charges. When, on the other hand, the cylinders are initiated substantially simultaneously (within a few microseconds), full detonation is obtained.

While the device of U.S. Pat. No. 8,256,350 may have certain advantages, it requires a complex initiation system to simultaneously initiate the neighboring charges. Additionally, in the same manner as it can be detonated by simultaneous initiation, it may be susceptible to other stimuli that can cause effectively simultaneous initiation in neighboring charges. For example, a shaped-charge jet penetrating with a velocity of 8000 m/sec crosses 3 nearby charges of a 16 mm diameter in 6 microseconds initiating them effectively simultaneously, and may cause full detonation. A fragment issuing from a detonated warhead or an Explosively Formed Projectile (EFP) penetrating at 2000 m/sec could also be a concern.

SUMMARY OF THE INVENTION

The present invention is a system and method for rendering an explosive device non-detonable until it is transformed into a detonable state.

According to the teachings of an embodiment of the present invention there is provided, a method comprising: (a) providing an explosive system comprising a plurality of portions, each portion comprising a quantity of explosive composition, each of the portions being of sub-critical dimensions such that initiation of the portion would result in incomplete detonation of the portion; (b) storing the explosive system with each of the portions deployed relative to each other of the portions such that at least part of the explosive system is unable to sustain detonation; (c) reconfiguring the explosive system by displacement of at least part of at least one of the portions to assume a detonation configuration in which complementary surfaces of the portions are brought into facing proximity so that the portions function as a combined explosive charge having effective dimensions larger than critical dimensions so as to sustain propagation of detonation to all parts of the combined explosive charge; and (d) detonating the combined explosive charge.

According to a further feature of an embodiment of the present invention, during the storing, the complementary surfaces are separated by a non-propagation gap sufficient to prevent propagation of detonation between the complementary surfaces.

According to a further feature of an embodiment of the present invention, the transforming is performed by manually grouping a plurality of portions.

There is also provided according to the teachings of an embodiment of the present invention, an explosive system comprising: (a) a plurality of portions, each portion comprising a quantity of explosive composition, each of the portions being of sub-critical dimensions such that initiation of the portion would result in incomplete detonation of the portion; and (b) a selectively-deployable spacer configuration associated with the plurality of portions and configured to selectively deploy between: (i) a storage configuration in which the spacer configuration maintains deployment of each of the portions relative to each other of the portions such that at least part of the explosive system is unable to sustain detonation, and (ii) a detonation configuration in which the spacer configuration allows displacement of at least part of at least one of the portions to bring together complementary surfaces of the portions into facing proximity so that the portions function as a combined explosive charge having effective dimensions larger than critical dimensions so as to sustain propagation of detonation to all parts of the combined explosive charge.

According to a further feature of an embodiment of the present invention, in the storage configuration, the complementary surfaces are spaced apart along an axis by a non-propagation gap sufficient to prevent propagation of detonation between the complementary surfaces, and the spacer configuration comprises at least one spacer block deployed between the complementary surfaces to maintain the gap, the spacer block being displaceable so as to allow axial displacement of the portions in the detonation configuration.

According to a further feature of an embodiment of the present invention, there is also provided an actuating arrangement deployed to apply force to at least one of the portions so as to close the gap between the portions in the detonation configuration.

There is also provided according to the teachings of an embodiment of the present invention, an explosive system comprising: (a) a plurality of portions, each portion comprising a quantity of explosive composition, each of the portions being of sub-critical dimensions such that initiation of the portion would result in incomplete detonation of the portion; and (b) a device associated with the plurality of portions and configured to selectively displace the plurality of portions between: (i) a storage configuration in which each of the portions is deployed relative to each other of the portions such that at least part of the explosive system is unable to sustain detonation, and (ii) a detonation configuration in which at least part of at least one of the portions is displaced to bring together complementary surfaces of the portions into facing proximity so that the portions function as a combined explosive charge having effective dimensions larger than critical dimensions so as to sustain propagation of detonation to all parts of the combined explosive charge.

According to a further feature of an embodiment of the present invention, in the storage configuration, the complementary surfaces are spaced apart along an axis by a non-propagation gap sufficient to prevent propagation of detonation between the complementary surfaces, the device being configured to displace the portions axially to assume the detonation configuration.

According to a further feature of an embodiment of the present invention, in the storage configuration, the complementary surfaces are in non-facing relation.

According to a further feature of an embodiment of the present invention, the plurality of portions are deployed within a casing.

According to a further feature of an embodiment of the present invention, the plurality of portions are interlinked as part of a flexible or hinged explosive charge.

BRIEF DESCRIPTION OF THE DRAWINGS

The invention is herein described, by way of example only, with reference to the accompanying drawings, wherein:

FIGS. 8*a* and 8*b* are schematic illustrations of a further embodiment of the invention showing a set of sub-critical charges in a non-detonable and a detonable state, respectively.

DESCRIPTION OF THE PREFERRED EMBODIMENTS

Figure 1A:
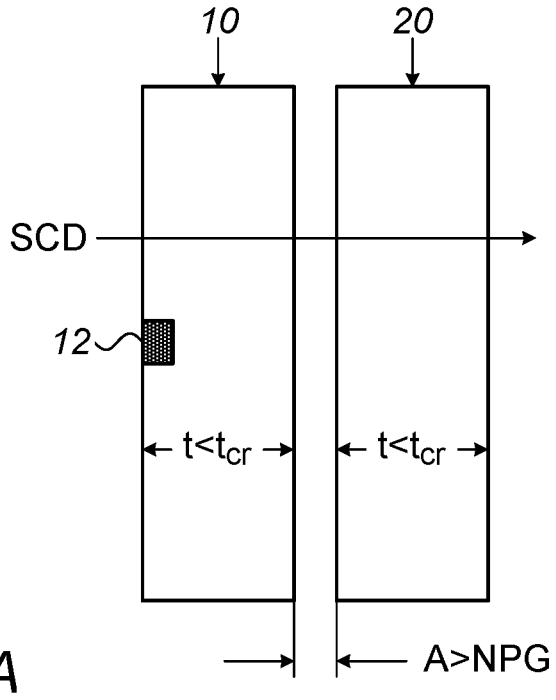
FIGS. 1*a* and 1*b* illustrate schematically a first embodiment of the invention showing two sub-critical charges separated and brought together, respectively.

The present invention is a system and method for rendering an explosive device non-detonable until it is transformed into a detonable state.

The principles and operation of systems and methods according to the present invention may be better understood with reference to the drawings and the accompanying description.

By way of introduction, the present invention provides an insensitive charge system that assumes a non-detonable state until shortly before detonation is required, and can be selectively transformed to a detonable state when required. Specifically, the states are preferably:

1. Non-detonable state, in which a plurality of sub-critical explosive charges are separated from each other by gaps (in some preferred cases air-gaps) large enough to deny propagation of the detonation, most preferably even in the case of simultaneous initiation of neighboring charges. It should be noted in this context that a sub-critical explosive charge may have a complex shape in which several charge sections are inter-connected at some of their boundaries and separated at their free surface boundaries, thereby denying the possibility of detonation propagation, whether initiation is done at one point or simultaneously at several points throughout the body. The minimum necessary separation distance between the sub-critical explosive charges for the above purpose is to be referred to as a Non-Propagation Gap (NPG).
2. Detonable state, in which the plurality of sub-critical explosive charges have been brought together to form an effectively contiguous explosive charge, in which the detonation can propagate throughout the charge undisturbed, as in an essentially contiguous body. That means that the plurality of charges are brought together into contact with the neighboring charges or with minimal gaps that have negligible effect on the propagation of detonation and therefore only one initiation point is necessary to detonate the entire charge system. It is to be understood that the sub-critical charges being "brought together" need not to be in close physical contact but rather to a distance that is small enough to enable detonation propagation. A spacing small enough to ensure reliable propagation of detonation is referred to herein as a Reliable Propagation Clearance (RPC). For detonation propagation purpose, this situation can be also referred to as the charges being in "effective contact".

The insensitive charge system may consist of a single charge which includes several interconnected bodies (portions or sections), each of them featuring a non-critical dimension. The charge system is non-detonable as long as the necessary separation between the charge sections exists and becomes detonable when the necessary separation is reduced below RPC. The transition from non-detonable to detonable state is preferably a mechanical transition, effected without any chemical reaction or any other change in the composition of the explosive material. In certain particularly preferred implementations, the transition is fully reversible.

The explosive system of the present invention may be implemented using at least one charge including a plurality of interconnected sub-critical explosive bodies (portions or sections) or a plurality of separate bodies (portions or sections) which are sub-critical charges, or any combination thereof, where the explosive system is configured to be transformed from a non-detonable state to a detonable state by displacing at least one part of at least one of the explosive bodies. In certain cases, particularly where highly flexible or explosive materials are used, the portions may not be clearly predefined, but rather may be defined by the manner in which the explosive material of sub-critical dimensions is reconfigured to form an effective explosive system of above-critical dimensions. One example of such a case would be arbitrarily chosen folding lines formed in a sheet (or "blanket") of explosive material of sub-critical thickness, More precisely stated, a group of any two sub-critical charges may be rendered non-detonable even if the sum of their sub-critical dimensions exceeds the critical dimension for the explosive material, provided at least one of the following non-detonability conditions is met:

a. The surfaces delimiting the sub-critical dimension of the charges are not in facing relation; or
b. The surfaces delimiting the sub-critical dimension of the charges are in facing relation, but are separated from each other by a distance greater than a Non-Propagation Gap (NPG).

Regarding "facing" surfaces, this refers to surfaces for which there is "overlap" between the surfaces. More precisely defined, this refers to positioning of a first surface so that a projection of that surface onto a second surface projected perpendicular to the second surface defines what is considered an "area of overlap". Examples of implementations of the invention rendered non-detonable in their storage states due at least in part to non-overlap are illustrated below with reference to FIGS. 2*a* and 8*a*. Partial overlap may, together with suitable choice of an initiation point, be used to provide scalability of the explosive effect by rendering only part of the explosive assembly detonable.

Where the sub-critical surfaces of the component explosive charges are in facing relation, the defining factor in achieving a detonable or non-detonable configuration is primarily the spacing ("gap") between the surfaces, and specifically, whether it lies above a non-propagation gap (NPG) for a safe non-detonable configuration, below a reliable propagation clearance (RPC) for reliable operation as a combined charge of above-critical dimensions, or at an intermediate gap value, which may provide statistically defined likelihood of effective detonation under various conditions. Various examples of implementations of the invention which are rendered non-detonable at least in part by a non-propagation gap are described below.

It should be noted that the various spatial definitions provided herein regarding surfaces of the charge portions ignore any texturing or other surface features of the explosive portions, so long as such features are sufficiently small that they do not compromise the ability to transfer detonation from one surface to the facing surface. Thus, for example, a roughened surface or a surface with relatively small ridges or indentations would, for the purpose of these definitions, be approximated by a smooth surface.

It should also be noted that the explosive portions are in certain implementations encapsulated by a thin layer of non-explosive material, which may be formed from a polymer material, soft metal, or from any other material suitable for a given application. Such encapsulation typically does not play a role in the function of the explosive portion, and may be neglected for the purpose of defining the geometry of the portions.

A state in which a group of two or more subcritical charges with a sum of sub-critical dimensions exceeding the critical dimension are brought together in facing relation, and in proximity so as to be mated together with spaces no greater than the RPC, results in a fully-detonable effective charge corresponding to the combination of the component charges.

Depending on the intended application, and dependent on design considerations and operational considerations, the explosive system may be configured so that the transformation from the non-detonable state to the detonable state is irreversible or is reversible.

There is abundant information about the critical diameter of several types of explosives. For example one can refer to pages 147-153 of Tactical Missile Warheads, Edited by Joseph Carleone, Volume 155 of Progress in Astronautics and Aeronautics, A. Richard Seebass, Editor-in-Chief, Published by the American Institute of Astronautics and Aeronautics. Such information may serve as a starting point for the design. For the purpose of refinement and optimization, for any specific type and design of charge, the inability to fully detonate when exposed to specific stimuli can be verified empirically.

The following table presents by way of example the critical diameters of some explosive compositions which are considered to be insensitive and therefore preferable for use in implementing explosive systems according to the teachings of the present invention if one wishes to provide a large charge by bringing together a minimum number of sub-charges. This is a non-limiting and non-exclusive list of suitable explosives, but it should be appreciated that the invention is equally applicable to any and all other explosives, with particularly preferred applications in the field of "insensitive explosives", defined herein as explosives having a critical diameter greater than 10 mm.

| Type of Explosive | Critical diameter (mm) |
|---|---|
| PBXW-115 (USA) | 38 |
| PBXW-115 (Australian) | 80 |
| ALIMX-101 | 127 |
| PBXIH-140 | 100 |

The detonability of the plurality of sub-critical charges when brought together, and specifically, the ability to detonate the entire charge system when initiated at one single point, is also preferably verified for each design empirically. This will also be addressed in more detail below.

In certain implementations, the principles of the present invention may also be used to implement a scalable-output warhead, where the output depends on the number of sub-critical explosive bodies which are brought together when transforming to detonable state.

Most preferred implementations of the present invention employ explosive materials in a solid form (as opposed to free-flowing liquid), although implementations in which liquid explosives are used, particularly where encapsulated within a solid envelope to define an overall form of the component, also fall within the broad scope of the present invention.

Figure 1B:
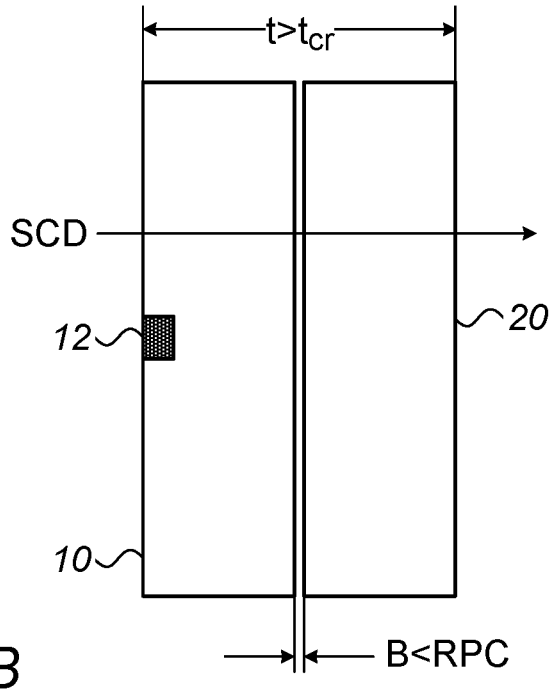

Referring now to the drawings, FIGS. 1*a* and 1*b* illustrate schematically a first preferred embodiment of an explosive system according to the teachings of an aspect of the present invention. In the non-detonable state of FIG. 1*a*, two sub-critical disc-shaped explosive charges 10 and 20 are kept separated at a separation distance A in their Sub-Critical Direction (SCD) exceeding the non-propagation gap NPG. The sum of the thicknesses of charges 10 and 20 exceeds the critical thickness of the explosive material used. In order to render the system detonable, the two charges are brought together into effective contact as shown in FIG. 1*b*, with any remaining gap B between them in the SCD being less than the reliable propagation clearance (RPC). A booster 12 is attached to only one of the charges (in this example to charge 10), for detonation of the entire charge when in the detonable state.

Transformation from the non-detonable state to the detonable state is advantageously automated by configuring a mechanical device to bring the charges together in the detonable state. Designing these devices is a straight-forward engineering task for those knowledgeable in the field of mechanical engineering. One non-limiting example is presented below with reference to FIGS. 5*a* and 5*b*, in conjunction with an embodiment similar to FIGS. 1*a* and 1*b*, and can readily be adapted to any of the embodiments of the invention presented herein.

It is understood that the device of FIGS. 1*a* and 1*b* can readily be implemented using more than two sub-critical disc-shaped charges. Furthermore, the charges of sub-critical thickness may be plates of with cross-sections other than circular, including but not limited to rectangular, square or trapezoidal.

Figure 2A:
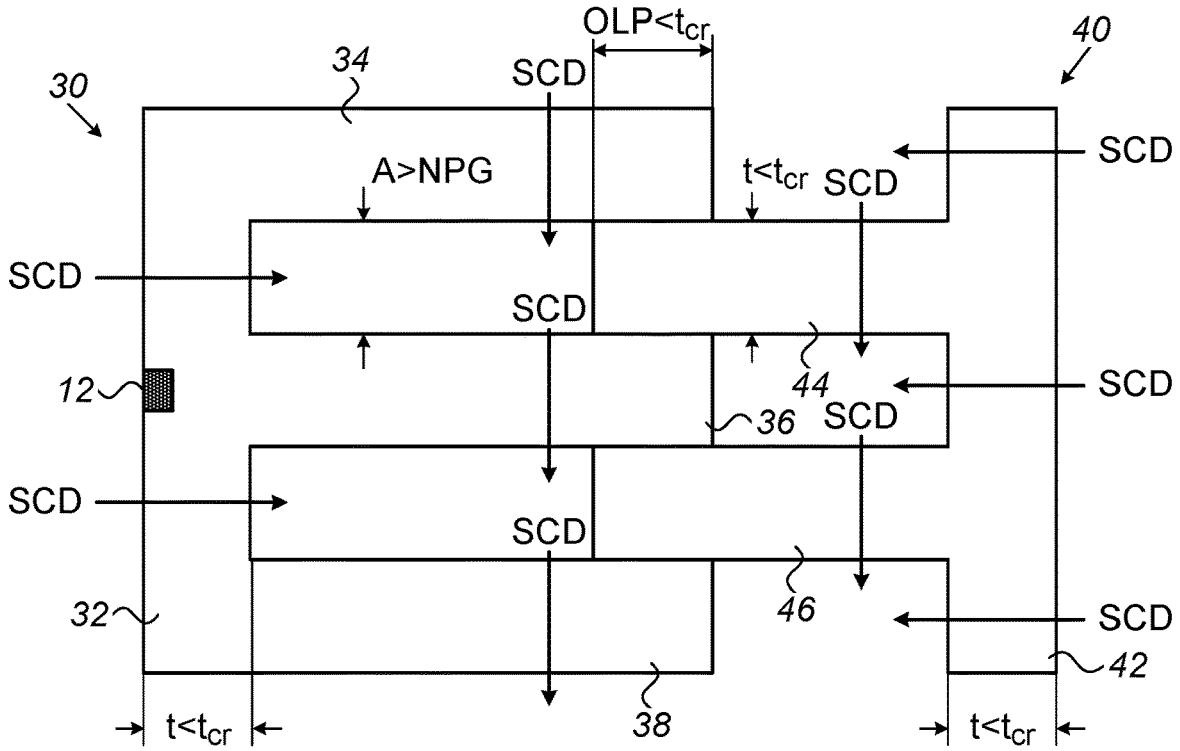
FIGS. 2*a* and 2*b* illustrate schematically a second embodiment of the invention showing two sub-critical charges separated and brought together, respectively.
Figure 2B:
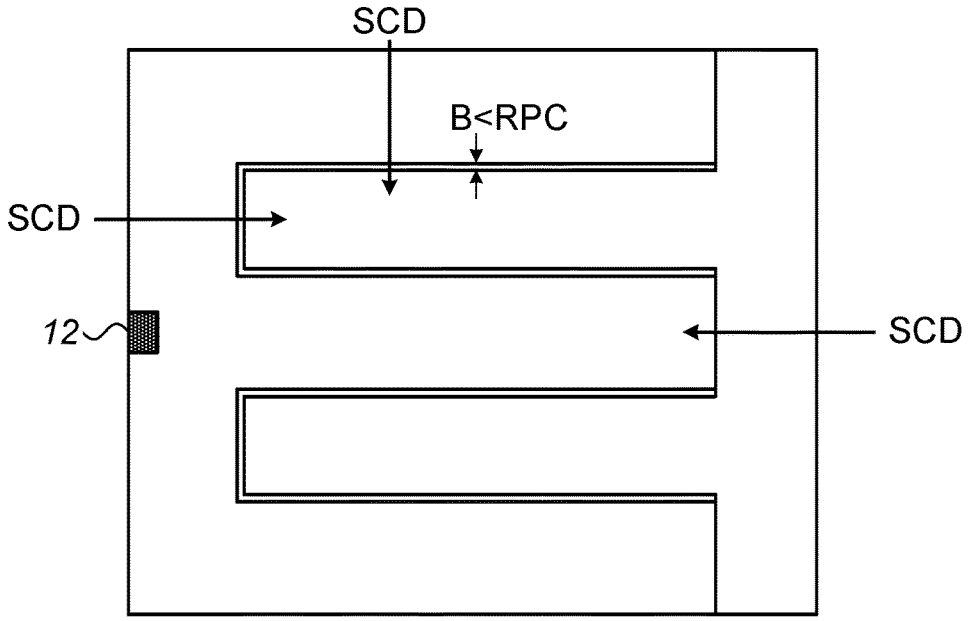

According to a second preferred embodiment, depicted schematically in FIGS. 2*a* and 2*b*, in the non-detonable state two sub-critical comb-shaped explosive charges 30 and 40 are kept partially separated with an overlap length OL which is less than the critical thickness. The bases 32 and 42 of the comb-shaped charges 30 and 32 as well as and the sub-charges 34, 36, 38, 44 and 46 are all of less than critical thickness, while the sum of the thicknesses of the explosive elements of non-critical thickness to be brought together exceeds the critical thickness of the explosive. The separation distance between neighboring sub-charges in the local sub-critical direction SCD is greater than the required non-propagation gap NPG. (FIG. 2*a*). In order to render the system detonable, the two charges are brought together into essential contact, all the gap between adjacent surfaces being less than the reliable propagation clearance (RPC)—see FIG. 2*b*. It should be noted that the booster 12 is attached to only one of the charges (in this example to charge 30). It is to be understood that in order to keep the charges apart in non-detonable state and to bring them together in the detonable state, a mechanical device is typically used. Design of such devices is a straight-forward engineering task for those knowledgeable in the field of mechanical engineering.

It should be noted that the cross-sectional view of FIGS. 2*a* and 2*b* may be part of an overall charge design which has rectangular symmetry, with a uniform cross-section as shown, or an arrangement of staggered rectangular rods which mate with each other. This design can also be used in a circular-symmetry implementation, where the structure becomes an arrangement of concentric cylinders which mate with each other.

Figure 3A:
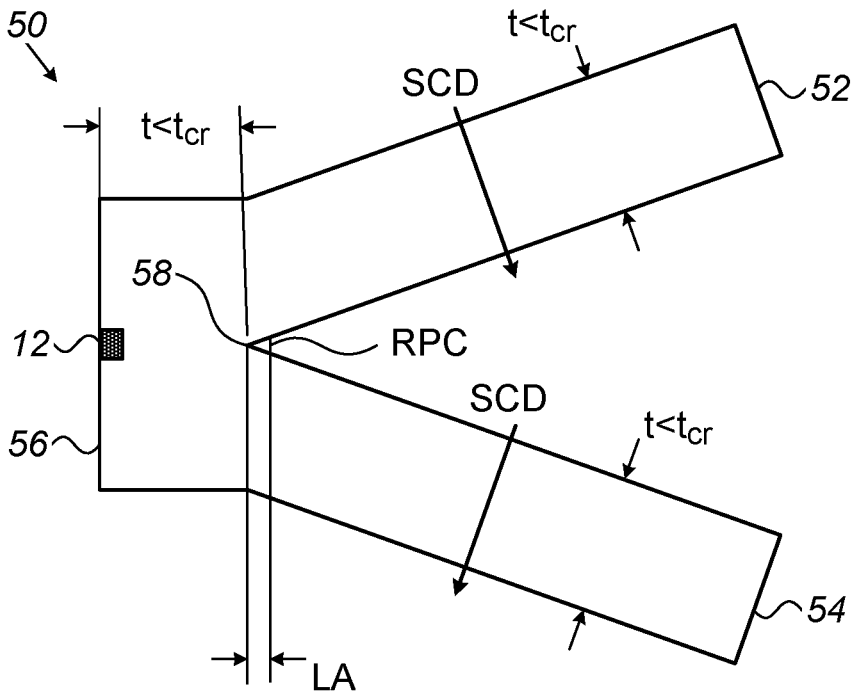
FIGS. 3*a* and 3*b* illustrate schematically a third embodiment of the invention showing two sub-critical charges separated and brought together, respectively.
Figure 3B:
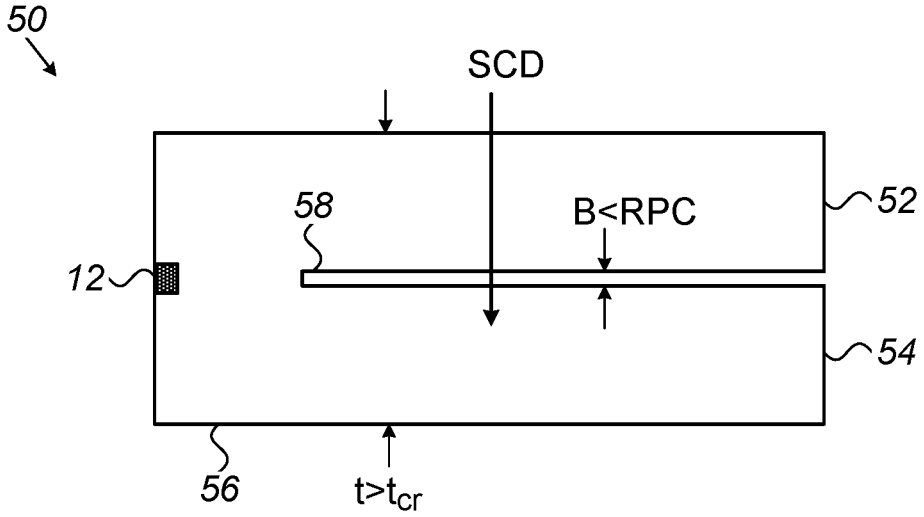

According to a third preferred embodiment, depicted schematically in FIGS. 3*a* and 3*b*, the explosive system consists of one contiguous explosive body 50. It refers to the case that the explosive body is highly flexible, which applies to most of the highly insensitive explosive composition with rubbery binder (such as HTPB). In the non-detonable state two sub-critical arm-shaped sub-charges 52 and 54 diverge from sub-critical base 56 and at a quite short axial distance LA from apex 58 the distance between the two arms exceeds the reliable propagation clearance RPC (FIG. 3*a*), and shortly beyond that point, the spacing between the arms in the sub-critical direction SCD exceeds the non-propagation gap NPG. Therefore, even if due to some stimulus the detonation starts nearby from the base area, it will decay very close to the apex. In order to render the system detonable, the two (or more) arms are brought together into effective contact, the gap B between them being less than the reliable propagation clearance (RPC), so as to assemble an overall charge of above-critical dimensions—see FIG. 3*b*. In this example, the booster 12 is attached to the base 56. It is to be understood that in order to keep the sub-charges apart in non-detonable state and to bring them together in the detonable state, mechanical devices are necessary. Designing these devices is a straight-forward engineering task for those knowledgeable in the field of mechanical engineering.

Figure 4A:
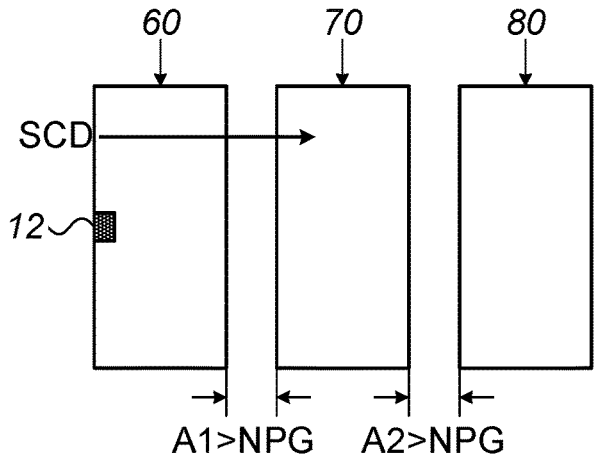
FIGS. 4*a*-4*c* illustrate schematically a fourth embodiment of the invention showing three sub-critical charges separated, with two sub-critical charges brought together and one charge separated, and with all three brought together, respectively.
Figure 4B:
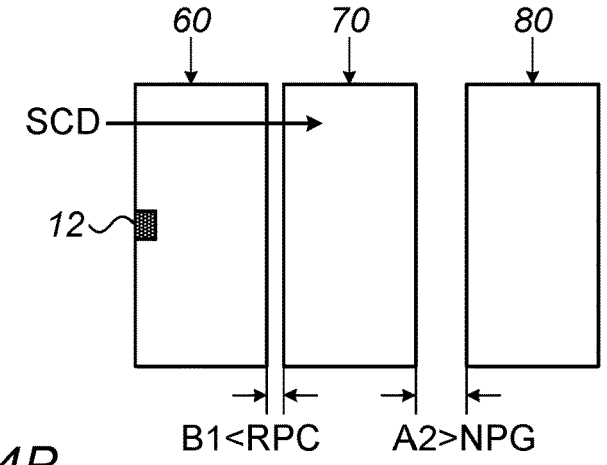
Figure 4C:
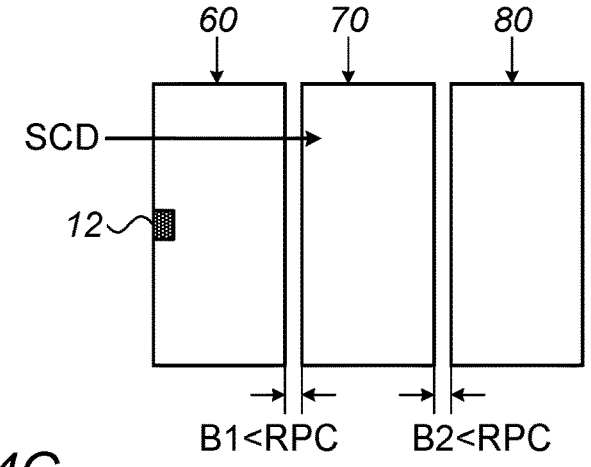

According to a fourth preferred embodiment, depicted schematically in FIGS. 4*a*-4*c*, in the non-detonable state, three sub-critical disc-shaped explosive charges 60, 70 and 80 are kept separated at a separation distances A1 and A2 measured in the sub-critical direction exceeding the non-propagation gap NPG (FIG. 4*a*). The sum of the thicknesses of neighboring explosive elements 60 and 70 exceeds the critical thickness of the explosive. The system can be rendered detonable with two possible outputs. As depicted in FIG. 4*b*, charges 60 and 70 can be brought together into effective contact, the gap B1 between them being less than the reliable propagation clearance (RPC) while charge 80 is left separated. When the booster 12, attached for example to charge 60, is detonated, charges 60 and 70 which have been brought together will detonate but charge 80 will only undergo a lower order reaction or will disintegrate. Therefore only a part of the total explosive within the warhead will detonate and less then maximum effect will be delivered. Alternatively, as depicted in FIG. 4*c*, all charges can be brought together into essential contact, the gaps B1 and B2 between them being less than the reliable propagation clearance (RPC), and detonated, delivering maximum effect. It is possible to build a system with more than three charges and the charges need not be of the same thickness, as long as they are of subcritical thickness.

Figure 5A:
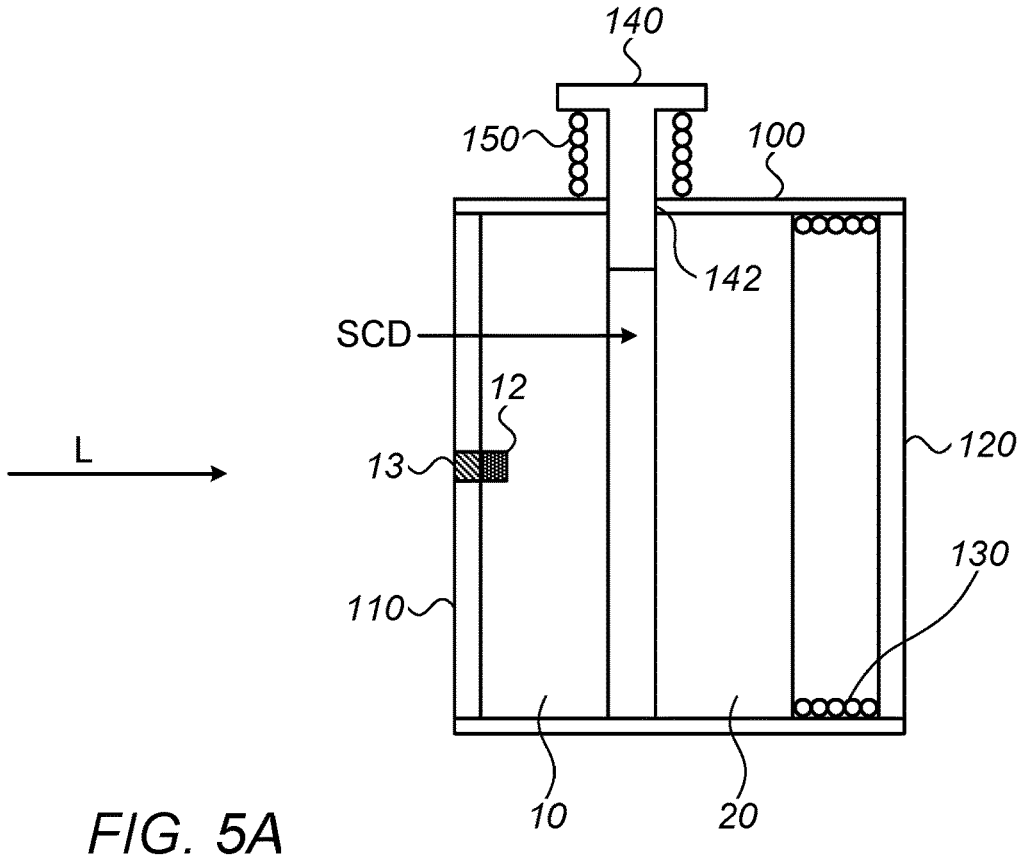
FIGS. 5*a* and 5*b* are schematic illustrations of an exemplary mechanical implementation of an embodiment of the present invention, showing a system in a non-detonable and a detonable state, respectively.
Figure 5B:
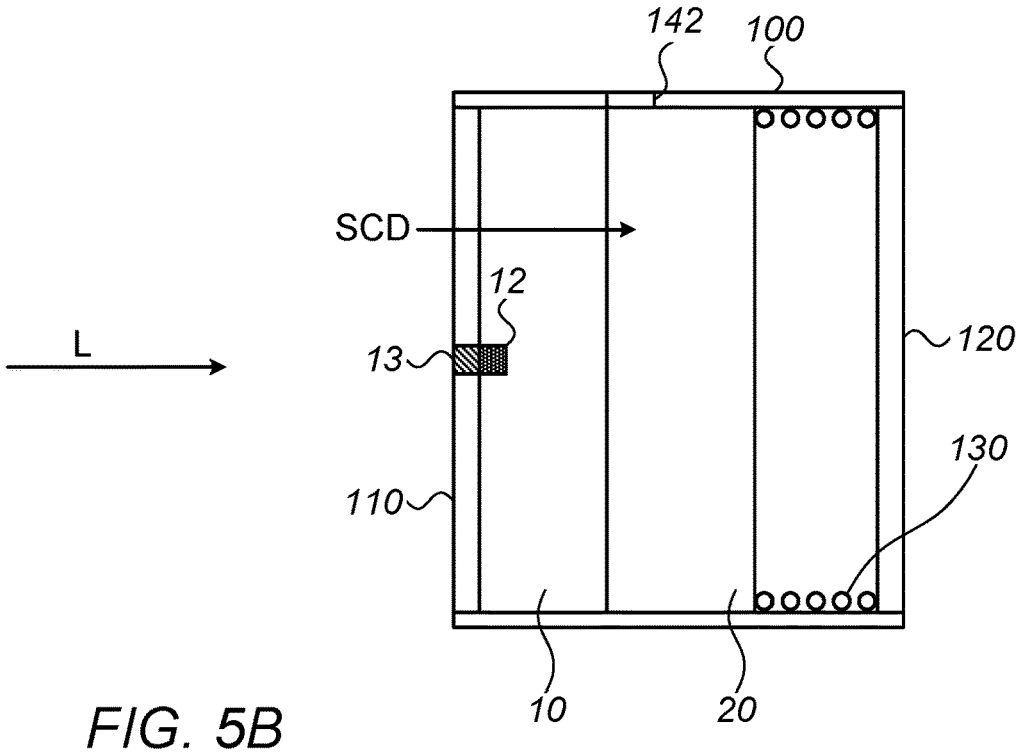

An exemplary mechanism is presented in FIGS. 5*a* and 5*b* for transforming an explosive system between the non-detonable and the detonable states. The exemplary device is presented in conjunction with an embodiment according to FIGS. 1*a* and 1*b*, but can readily be adapted to any of the embodiments of the invention presented herein. In the non-detonable state, two sub-critical disc-shaped explosive charges 10 and 20 are encompassed by cylindrical envelope 100 with two disc-shaped covers 110 and 120 threaded into it. The sum of the thicknesses of the explosive elements exceeds the critical thickness of the explosive. Cover 110 accommodates a small pyrotechnic lead charge 13 which is part of the pyrotechnic train for transferring the detonation input to booster 12 accommodated by charge 10. A coil spring 130 is deployed between charge 20 and cover 120 and is in compressed condition in the non-detonable state of the system (FIG. 5*a*). An inert (i.e., non-explosive) spacer 140 of a thickness larger than the NPG is deployed between parts of the opposing surfaces of charges 10 and 20 and extends radially through an opening 142 of envelope 100, so as to maintain a spacing larger than NPG in the sub-critical direction SCD between charges 10 and 20. A release mechanism, exemplified here by a loaded spring 150, may be provided to displace spacer 140 outwards when required (FIG. 5*a*). A locking or retaining arrangement (not shown) preferably prevents premature operation of the release mechanism.

Upon activation of the release mechanism, spacer 140 moves outwards radially and coil-spring 130 expands longitudinally, thereby bringing charges 10 and 20 into effective contact. As the sum of the thicknesses of charges 10 and 20 is above the critical system, the system is now in detonable state (FIG. 5*b*).

Booster 12 need not necessarily be integrated with charge 10. It may be a separate unit between cover 110 and charge 10 or it may be attached to the external side of cover 110 (the side remote from charge 10) and in such case the detonation input (such as lead charge or detonator) connectable to it. The design of the booster and the entire initiation chain is a subject well-known to those in the art of pyrotechnics and explosive charge, and many solutions are possible within the scope of the abilities of a person having ordinary skill in the art. It is particularly preferred feature of certain implementations of the present invention that only a single, simple detonation input is required.

As a matter of definition, the direction perpendicular to the bases of the cylinders is defined as the longitudinal direction and indicated by Arrow L in FIG. 5. The sub-critical dimension of the explosive charges (of disc shape or possibly other shapes such as rectangular, square, trapezoidal, triangular) defines the sub-critical direction SCD, and is in this case along the longitudinal direction.

As illustrated above in FIGS. 2*a*-2*b* and 3*a*-3*b*, charges with more complex forms may have regions with different, non-parallel SCDs according to their local shape or contour. In each case, the "gap" to be evaluated as being greater than the NPG for the non-detonable state is the gap in the local SCD. Various regions of the system of charges may also be rendered non-detonable due to non-overlap, as discussed above.

In the case that the sub-critical charges are or rectangular plate shape rather than of cylindrical disc shape, the encompassing envelope will typically be a box with rectangular cross-section. At least one of the lateral faces of the box (i.e. faces with the normal perpendicular to the longitudinal direction) may be at least partially reversibly openable, thereby enabling manual removing of spacers between the plates and bringing the plates together under the action of a coil-spring such as 130, or manually or under the action of gravity (in case that the box is positioned with its longitudinal direction oriented vertically). Although less convenient, reversibly removing part of the cylindrical envelope in order to remove the spacers, could be also possible in case that the charges are disc-shaped. If the booster is a separate unit within the envelope or the box, a further removable spacer may be located between the booster and first charge 10 keeping them apart in the non-detonable state and upon its removal enabling bringing the booster together with plate 10.

It is to be understood that in a system with more than two plates, selective removal of a number of spacers while leaving a number of spacers in place can be used to determine how many plates will detonate. Alternatively the operator may actually remove some of the plates through the reversibly openable face (cover) of the box and thereby scale the output of the system.

A large variety of alternate means could be used for implementation of the invention. For example the charges could be brought together by the action for example but not limited of various types of actuators (manual, electrical, pneumatic, hydraulic, shape-memory alloy), by the traction of a cord being pulled by a rocket motor, by direct action of a pyrotechnic propulsion arrangement, by acceleration or by deceleration, or by action of gravity.

The spacer between the charges may be made of various types of materials, such as rubber, foam (including but not limited to metal foam), and composite material. The spacer may be crushable or collapsible above a certain force threshold level so that the spacer does not need to be "removed" but is rather neutralized or overcome by forces applied to actuate the transformation to the detonable state.

The release mechanism may be manually operated or by the effect of any type of actuator, which may be triggered by any desired condition. It may be connected to a bore-rider released when ammunition leaves a launcher or a lanyard.

The various spacers between the various charges may constitute one body or separate bodies and in the latter case may be interconnected or not. Accordingly, in general the spacers may be moved by the action of one or more actuators of any type, for example but not limited to manual, electrical, pneumatic, hydraulic, shape-memory alloy.

Although described herein with reference to various mechanisms for transforming the system between the non-detonable and the detonable states, it is to be understood that, in a basic implementation, the present invention may be used to advantage in a context in which the charges are manually displaced between the non-detonable and the detonable states. By way of one non-limiting example, FIGS. 8*a* and 8*b* illustrate an explosive system in which a number of sub-critical rectangular slab charges are interconnected by connection to a common flexible strip, which may be a textile or polymer strip. In the straightened state of FIG. 8*a*, the component charges are non-overlapping, and are therefore non-detonable, despite the fact that peripheral edges of the charges may be in close proximity. When it is desired to detonate the explosive system, the strip is folded so that the slabs lie one-above-the-other as illustrated in FIG. 8*b*, providing a combined charge which is above-critical, ready for detonation. (Details of a booster etc. are omitted for simplicity.) An equivalent system can be implemented with direct hinged attachment between adjacent portions in a Z-fold configuration (not shown). In a further variant, a continuous flexible sheet (or "blanket", not shown) of explosive material, such as of Composition C-4 (known as "plastic explosives") may be formed with a sub-critical thickness, rendering it non-detonable. Prior to use, the blanket is folded on itself one or more times to a configuration with above-critical effective thickness, thereby rendering it detonable. This exemplifies a case in which the "portions" of the explosive device may not be clearly defined until the blanket is folded, after which the regions between the folds effectively become the "portions" which are brought into proximity with each other.

Manually transformable explosive systems are particularly useful for various blasting applications and in civilian mining and quarrying applications. Even where manual transformation is used, it is preferably to provide an arrangement of spacers and/or a rigid support (not shown) in order to keep the charges reliably in non-overlapping relation in the non-detonable state. Most preferably, a suitable sheath or other packaging (not shown) also ensures that the sub-critical portions do not come into sufficiently close proximity to sub-critical portions of an adjacent stored device (where multiple devices are stored together) to form a detonable combination.

Figure 9A:
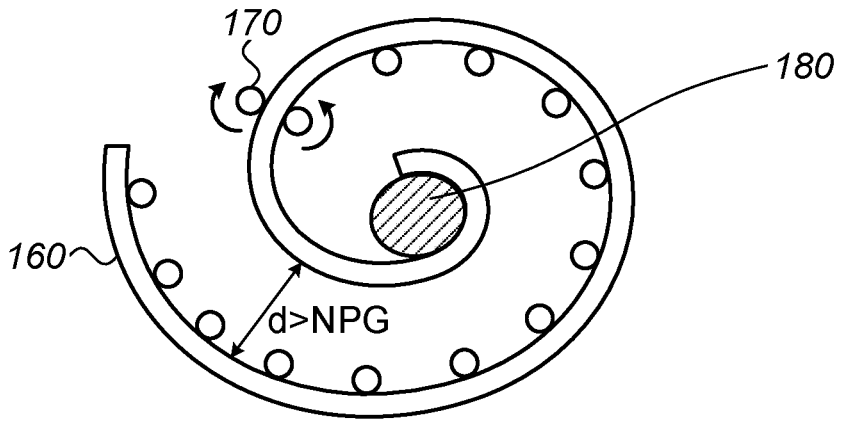
FIGS. 9*a* and 9*b* are schematic illustrations of a further embodiment of the invention showing a set of sub-critical charges in a non-detonable and a detonable state, respectively.
Figure 9B:
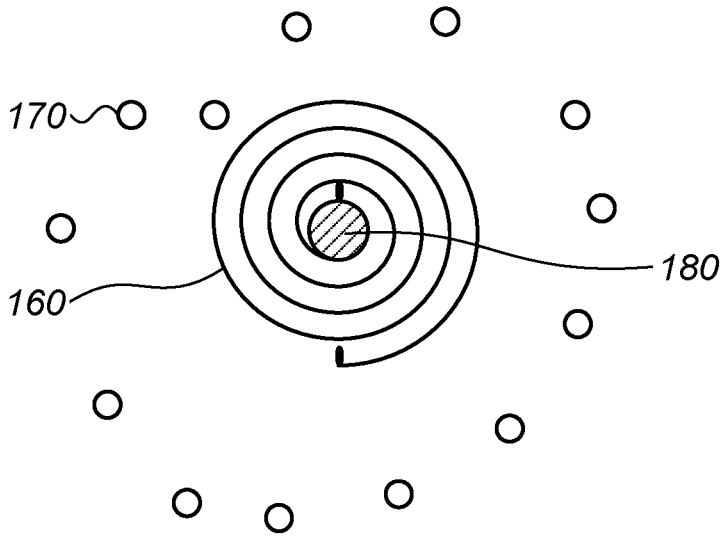

Turning to FIGS. 9*a* and 9*b*, these illustrate a further embodiment of the invention in which an explosive charge is of a spiral shape or, more precisely, a flexible sheet of material wound on itself into a spiral form. In the undetonable state, the spacing between sections of the spiral charge is maintained above the Non-Propagation Gap. The spacing is preferably maintained by providing a spacer system, which may include separate elements, such as pins or rods which extend inwards into the rolled spiral form, or one complex body that fits into the spaces between the sections of the spiral curve. By first removing the spacer system and subsequently applying mechanical torque on the spiral charge, such as by rotating a central rod relative to an external support, the flexible sheet of explosive material becomes wrapped progressively more tightly around the central rod. This results in closing up of the radial spacing between turns of the spirally-wound flexible sheet charge so that the gaps between successive turns/layers of the sheet in any given radial direction are reduced to a value below the Reliable Propagation Clearance and the charge becomes detonable.

The Non-Propagation Gap (NPG) and the Reliable Propagation Clearance (RPC) are characteristic properties of the specific type of explosive. The NPG is also a function of the form-factor of the charges and confinement effects of a surrounding structure.

Figure 6:
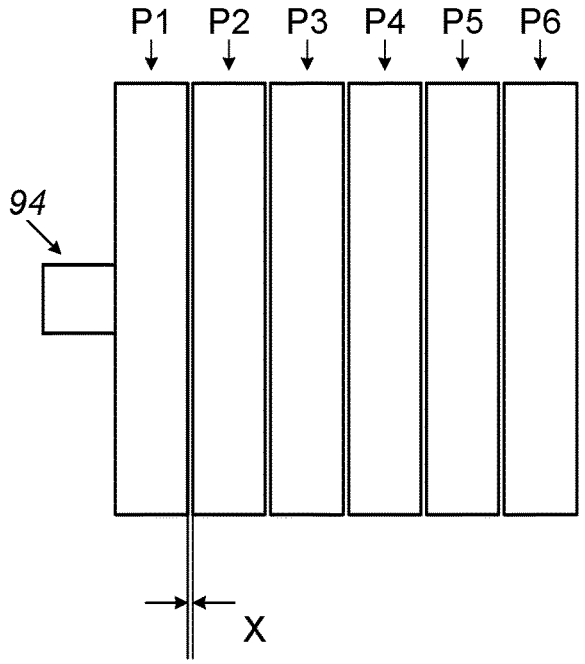
FIG. 6 is a schematic representation of an exemplary test set-up for determining a value of a Reliable Propagation Clearance (RPC)

FIG. 6 presents a schematic test set-up for determining the value of the RPC. Six sub-critical explosive plates (P1-P6) are positioned with a predetermined spacing X between the neighboring plates, where the sum of the thicknesses of the explosive elements exceeds the critical thickness of the explosive. A booster charge 94 is attached to plate P1 and detonation of plate P1 is initiated. Depending on the spacing between the plates, the detonation may or may not propagate through all the plates. Detonation of the entire explosive mass is the determining criterion for the Reliable Propagation Clearance (or Reliable Propagation Clearance). In a series of tests, the spacing X between the plates is stepwise varied to make a determination of the Reliable Propagation Clearance.

Figure 7:
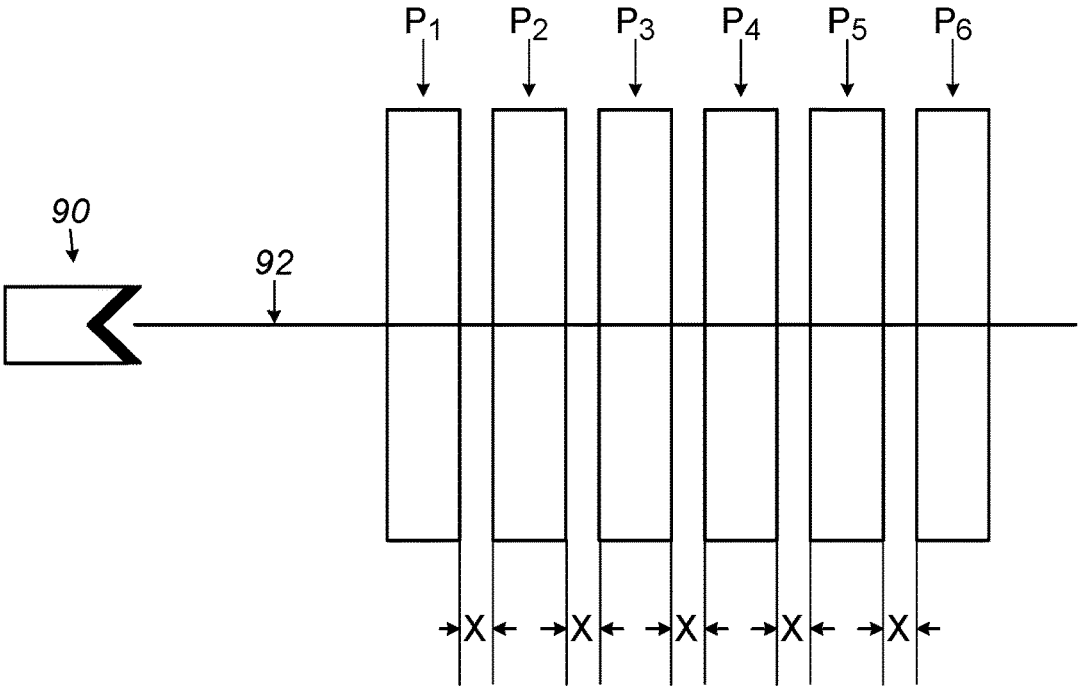
FIG. 7 is a schematic representation of an exemplary test set-up for determining the value of a Non-Propagation Gap (NPG)

FIG. 7 presents a schematic test set-up for determining the value of the NPG. Six sub-critical explosive plates (P1-P6) are positioned with a predetermined spacing X between the neighboring plates along the sub-critical direction. The sum of the thicknesses of the explosive elements exceeds the critical thickness of the explosive. A shaped charge 90 is placed in a perpendicular orientation and detonated, causing the jet 92 it generates to impact, initiate and penetrate the plates in very close time sequence. This very close sequence is a consequence of the jet tip moving at a typical velocity of 7-9 km/sec. The combined effect of neighboring non-critical plates brought close enough together and initiated substantially simultaneously may provide effective mutual confinement that enables them to sustain detonation, even where one-point detonation would not be sustained. In order to determine a value of NPG that renders a device insensitive even to extreme external stimulus, such as that of a shaped charge, a series of tests is preferably performed varying the spacing X between the various plates stepwise to make a determination of the Non-Propagation Gap at which detonation does not occur.

The determining reaction is that of the innermost plates P3 and P4, because they are practically unaffected by free side-boundary effects such as experienced by P1 and P6 and at a much lesser degree by P2 and P5. Therefore a detonation propagation outcome of the test is achieved when plates P3 and P4 detonate in their entirety, without any residuals. The value of NPG is determined when X is sufficient to result in a detonation non-propagation outcome, even for plates P3 and P4.

It should be noted that the shaped-charge jet is the leading criterion in the design of an insensitive explosive system and therefore the tests for determining the NPG are conducted with one shaped-charge generating a jet perpendicular to the plates and thereby initiating them in very close sequence. Were the system being required to be designed to lesser threats (for example fragment impact) the plates could be exposed to such threat and a lesser value of the NPG may be determined.

The values of NPG are influenced by various design considerations, such as the geometry of the charges and any confinement provided by a casing etc. The above tests should therefore be repeated during the design of each new explosive system under conditions matching the proposed design.

The various plates (sub-critical explosive charges) may be of different types of explosives. In such cases, with differing critical dimensions, estimated values for NPG may be complex to derive theoretically, but the empirical determination described above remains effective. Additionally, the explosive material may be integrated with additional structures or elements, such as for example pre-formed fragments or an envelope, to form portions of the explosive system. The various plates (sub-critical explosive charges) may be of different thicknesses. In particular, a plate adjacent to a significant confining wall may be of reduced thickness compared to the other plates in order to ensure that it remains "sub-critical", because, in the presence of a confining wall near the explosive plate, its critical thickness is smaller than that of a unconfined plate.

A wide range of applications are well-suited for the present invention. By way of example, a non-exclusive list is presented. In all cases the items are stored and transported in un-detonable state and only before actual use are transformed into detonable state.

a. Demolition charges
b. Warheads of unguided rockets and guided missiles
c. Aerial bombs
d. Mine-clearing charges (such as the US M58 MICLIC). The mine-clearing device in general includes a multitude of detonating charges connected by a cord deployed by the traction of a rocket motor and in which a detonation cord transmits the detonation stimulus from charge to charge after the mine-clearing device is deployed. According to an implementation of the present invention, prior to deployment, each charge includes sub-critical explosive elements spaced apart in an un-detonable state. The traction of the rocket motor as transmitted through the deployment cord applies a force that, operating via an appropriate mechanism, brings the sub-critical explosive elements together, thereby transforming the system into its detonable state.
e. Reactive armor system. There are tanks and other armored fighting vehicles outfitted with reactive armor. Whenever these vehicles are not in combat situation, the reactive armor is a safety concern for the personnel and equipment nearby. When the explosive in the reactive armor plates detonates, the inert elements of the reactive armor (such as plates) can be projected to considerable distance. It is therefore of advantage to design reactive armor elements according to the principles of the present invention in which the explosive charge is split into two units each with a sub-critical explosive layer (possibly with a thin cover at the interface surface) and when entering combat bringing the units together thereby bringing the system into detonable condition.

To the extent that the appended claims have been drafted without multiple dependencies, this has been done only to accommodate formal requirements in jurisdictions which do not allow such multiple dependencies. It should be noted that all possible combinations of features which would be implied by rendering the claims multiply dependent are explicitly envisaged and should be considered part of the invention.

It will be appreciated that the above descriptions are intended only to serve as examples, and that many other embodiments are possible within the scope of the present invention as defined in the appended claims.

What is claimed is:

1. A method comprising:
(a) providing an explosive system comprising a plurality of portions, each portion comprising a quantity of explosive composition, each of said portions being of sub-critical dimensions such that initiation of the portion would result in incomplete detonation of the portion;
(b) storing the explosive system with each of said portions deployed relative to each other of said portions such that at least part of the explosive system is unable to sustain detonation; and
(c) reconfiguring the explosive system by displacement of at least part of at least one of said portions to assume a detonation configuration in which complementary surfaces of said portions are brought into facing proximity so that said portions function as a combined explosive charge having effective dimensions larger than critical dimensions so as to sustain propagation of detonation from a single initiation point to all parts of said combined explosive charge.

2. The method of claim 1, wherein, during said storing, said complementary surfaces are separated by a non-propagation gap sufficient to prevent propagation of detonation between said complementary surfaces.

3. The method of claim 1, wherein, during said storing, said complementary surfaces are in non-facing relation.

4. The method of claim 1, wherein said transforming is performed by manually grouping a plurality of portions.

5. The method of claim 1, wherein said storing is performed within a casing.

6. The method of claim 1, wherein said plurality of portions are interlinked as part of a flexible or hinged explosive charge.

7. An explosive system comprising:
(a) a plurality of portions, each portion comprising a quantity of explosive composition, each of said portions being of sub-critical dimensions such that initiation of the portion would result in incomplete detonation of the portion; and
(b) a selectively-deployable spacer configuration associated with said plurality of portions and configured to selectively deploy between:
(i) a storage configuration in which said spacer configuration maintains deployment of each of said portions relative to each other of said portions such that at least part of the explosive system is unable to sustain detonation, and
(ii) a detonation configuration in which said spacer configuration allows displacement of at least part of at least one of said portions to bring together complementary surfaces of said portions into facing proximity so that said portions function as a combined explosive charge having effective dimensions larger than critical dimensions so as to sustain propagation of detonation to all parts of said combined explosive charge.

8. The explosive system of claim 7, wherein, in said storage configuration, said complementary surfaces are spaced apart along an axis by a non-propagation gap sufficient to prevent propagation of detonation between said complementary surfaces, and said spacer configuration comprises at least one spacer block deployed between said complementary surfaces to maintain said gap, said spacer block being displaceable so as to allow axial displacement of said portions in said detonation configuration.

9. The explosive system of claim 8, further comprising an actuating arrangement deployed to apply force to at least one of said portions so as to close said gap between said portions in said detonation configuration.

10. The explosive system of claim 7, wherein, in said storage configuration, said complementary surfaces are in non-facing relation.

11. The explosive system of claim 7, wherein said plurality of portions are deployed within a casing.

12. The explosive system of claim 7, wherein said plurality of portions are interlinked as part of a flexible or hinged explosive charge.

13. An explosive system comprising:

(a) a plurality of portions, each portion comprising a quantity of explosive composition, each of said portions being of sub-critical dimensions such that initiation of the portion would result in incomplete detonation of the portion; and (b) a device associated with said plurality of portions and configured to selectively displace said plurality of portions between:

(i) a storage configuration in which each of said portions is deployed relative to each other of said portions such that at least part of the explosive system is unable to sustain detonation, and (ii) a detonation configuration in which at least part of at least one of said portions is displaced to bring together complementary surfaces of said portions into facing proximity so that said portions function as a combined explosive charge having effective dimensions larger than critical dimensions so as to sustain propagation of detonation to all parts of said combined explosive charge.

14. The explosive system of claim 13, wherein, in said storage configuration, said complementary surfaces are spaced apart along an axis by a non-propagation gap sufficient to prevent propagation of detonation between said complementary surfaces, said device being configured to displace said portions axially to assume said detonation configuration.

15. The explosive system of claim 13, wherein, in said storage configuration, said complementary surfaces are in non-facing relation.

16. The explosive system of claim 13, wherein said plurality of portions are deployed within a casing.

17. The explosive system of claim 13, wherein said plurality of portions are interlinked as part of a flexible or hinged explosive charge.

* * * * *